US011754291B2

(12) United States Patent
Cowan et al.

(10) Patent No.: US 11,754,291 B2
(45) Date of Patent: Sep. 12, 2023

(54) MODULATING OVEN BURNER CONTROL FOR GAS COOKING APPLIANCE

(71) Applicant: Midea Group Co., Ltd., Foshan (CN)

(72) Inventors: Richard W. Cowan, Louisville, KY (US); Daniel J. Trice, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 411 days.

(21) Appl. No.: 17/035,049

(22) Filed: Sep. 28, 2020

(65) Prior Publication Data

US 2022/0099302 A1 Mar. 31, 2022

(51) Int. Cl.

*F23N 1/00* (2006.01)
*F24C 3/12* (2006.01)
*F24C 3/08* (2006.01)

(52) U.S. Cl.

CPC ..... *F24C 3/128* (2013.01); *F23N 1/005* (2013.01); *F24C 3/087* (2013.01); *F23N 2235/16* (2020.01)

(58) Field of Classification Search

CPC ..... F24C 3/128; F24C 3/087; F23N 1/005; F23N 2235/16
USPC ..... 126/39 BA
See application file for complete search history.

(56) References Cited

U.S. PATENT DOCUMENTS 4,819,587 A 4/1989 Tsutsui et al.
5,234,196 A 8/1993 Harris
5,606,236 A 2/1997 Tennies et al.
5,865,164 A 2/1999 Garceau et al.
7,231,917 B2 * 6/2007 Frederiksen ..... F24C 3/128 126/39 BA
7,959,433 B2 6/2011 Huff
8,678,345 B2 3/2014 Gum
8,863,734 B2 10/2014 Shaffer
(Continued)

FOREIGN PATENT DOCUMENTS

AU 681912 B 9/1997
CN 103836642 A 6/2014
(Continued)

OTHER PUBLICATIONS

Gas Valve Automatically Optimises Combustion, Retrieved from: https://mag.ebmpapst.com/en/industries/heating/gas-valve-automatically-optimises-combustion_8364/ Mar. 2014.
(Continued)

*Primary Examiner* — Avinash A Savani
(74) *Attorney, Agent, or Firm* — Gray Ice Higdon

(57) ABSTRACT

A cooking appliance including an oven compartment, and first and second gas burners positioned to supply heat to the oven compartment. The first and second gas burners respectively include first and second electromechanical modulating valves that respectively couple the first and second gas burners to a gas supply. A controller is used to control the first and second gas burners to heat the oven compartment, and the controller, when maintaining a predetermined temperature in the oven compartment, controls the electromechanical modulating valves of the first and second gas burners to vary respective output levels of the first and second gas burners while maintaining a substantially constant combined output level for the first and second gas burners.

20 Claims, 5 Drawing Sheets

(56) References Cited

U.S. PATENT DOCUMENTS

| | | | | |
|---|---|---|---|---|
| 9,317,046 | B2 | 4/2016 | Gum | |
| 9,841,191 | B2 | 12/2017 | Johncock et al. | |
| 9,958,164 | B1 | 5/2018 | Frost | |
| 2006/0051718 | A1* | 3/2006 | Kamal | F24C 3/085 431/278 |
| 2009/0104573 | A1 | 4/2009 | Chen | |
| 2015/0020692 | A1* | 1/2015 | Frank | F24C 3/122 431/12 |
| 2018/0174809 | A1 | 6/2018 | Schuethe | |

FOREIGN PATENT DOCUMENTS

| | | | | |
|---|---|---|---|---|
| DE | 102014216773 | A1 | | 2/2016 |
| EP | 0781965 | A1 | | 7/1997 |
| EP | 2993407 | A1 | * | 3/2016 |
| EP | 2993407 | A1 | | 3/2016 |
| JP | 2001012742 | A | | 1/2001 |
| JP | 2004060961 | A | | 2/2004 |
| JP | 2007298224 | A | | 11/2007 |
| JP | 2021032487 | A | * | 3/2021 |
| JP | 2021032487 | A | | 3/2021 |
| WO | 2011108016 | A1 | | 9/2011 |

OTHER PUBLICATIONS

Savani, Avinash A., U.S. Patent and Trademark Office, Non-Final Office Action issued in U.S. Appl. No. 17/035,049 dated Jan. 13, 2023.

* cited by examiner

MODULATING OVEN BURNER CONTROL FOR GAS COOKING APPLIANCE

BACKGROUND

In a gas cooking appliance, such as a gas oven, electronic controls are typically utilized and gas burners typically operate at a maximum flow. The gas burner of the cooking appliance may then be cycled on and off in order to keep the temperature at a desired value. Conventionally, these systems operate over the full desired range of the appliance (e.g. approximately 165 degrees Fahrenheit to 550 degrees Fahrenheit for an oven).

A gas burner of a cooking appliance may also require enough power to reach self-clean temperatures (e.g. approximately 800 degrees Fahrenheit). There is a need for a high power burner to preheat quickly (and, where applicable, reach self-clean temperatures); however, there is also a need to reduce the power to maintain a set temperature, for example when baking. As such, these power needs may result in large swings in the temperature when maintaining a set temperature, for example 350 degrees Fahrenheit.

Therefore, a significant need continues to exist in the art for a manner of regulating oven temperature in a gas cooking appliance over a wide range of temperatures.

SUMMARY

The herein-described embodiments address these and other problems associated with the art by providing an appliance, such as a cooking appliance, with multiple gas oven burners that are capable of being modulated to vary the output of the multiple gas burners to optimize temperature control within the oven. For example, in an aspect, the cooktop appliance includes an oven compartment; a first and a second gas burner positioned to supply heat to the oven compartment; where the first and second gas burners respectively include first and second electromechanical modulating valves that respectively couple the first and second gas burners to a gas supply; and a controller to control the first and second gas burners to heat the oven compartment, where the controller is further configured to, when maintaining a predetermined temperature in the oven compartment, control the electromechanical modulating valves of the first and second gas burners to vary respective output levels of the first and second gas burners while maintaining a substantially constant combined output level for the first and second gas burners.

In some embodiments, the controller is further configured to vary respective output levels of the first and second gas burners between a minimum output level and a maximum output level when maintaining the predetermined temperature in the oven compartment. In some such embodiments, the controller is further configured to modify a frequency of the varying of the respective output levels of the first and second gas burners when maintaining the predetermined temperature in the oven compartment.

In some embodiments, the first gas burner has a higher output level than the second gas burner, and the controller is further configured to vary, by the electromechanical modulating valves, the output level of the first and second gas burners so that the first gas burner has a lower output level than the second gas burner, when maintaining a predetermined temperature in the oven compartment, thereby relocating a hot spot in the oven compartment and disrupting airflow in the oven compartments. In other embodiments, the controller is further configured to vary, by the electromechanical modulating valves, the respective output levels of the first and second gas burners in an irregular manner, when maintaining a predetermined temperature in the oven compartment, thereby resulting in a disruption of an airflow pattern in the oven compartment. In still other embodiments, the controller is further configured to vary the respective output levels of the first and second gas burners in a regular pattern, when maintaining a predetermined temperature in the oven compartment, thereby resulting in a disruption of an airflow pattern in the oven compartment. In still yet other embodiments, the controller is further configured to modify a frequency of the varying of the respective output levels of the first and second gas burners when maintaining a predetermined temperature in the oven compartment.

In some embodiments, the cooking appliance additionally includes a third gas burner positioned to supply heat to the oven compartment and a third electromechanical modulating valve that couples the third gas burner to a gas supply. In some such embodiments, the controller is further configured to vary, by the electromechanical modulating valves, the respective output levels of the first, second, and third gas burners when maintaining a predetermined temperature in the oven compartment.

In some embodiments, each of the first and second electromechanical modulating valves is a stepper motor-controlled plug valve. In other embodiments, each of the first and second electromechanical modulating valves is a voice coil solenoid valve. In some embodiments, the first gas burner is larger than the second gas burner, and where the first gas burner has an output range that overlaps with an output range of the second gas burner.

In another aspect, a cooking appliance includes: an oven compartment; first and second gas burners positioned to supply heat to the oven compartment; where the first and second gas burners respectively include first and second electromechanical modulating valves that respectively couple the first and second gas burners to a gas supply; and a controller configured to control the first and second gas burners to heat the oven compartment, where the controller is further configured to, when maintaining a predetermined temperature in the oven compartment, control the electromechanical modulating valves of the first and second gas burners to vary respective output levels of the first and second gas burners between a minimum output level and a maximum output level.

In some embodiments, the controller is further configured to maintain a substantially constant combined output level for the first and second gas burners when maintaining a predetermined temperature in the oven compartment. In other embodiments, the controller is further configured to modify a frequency of the varying of the respective output levels of the first and second gas burners when maintaining a predetermined temperature in the oven compartment. In still other embodiments, the first gas burner has a higher output level than the second gas burner, and the controller is further configured to vary, by the electromechanical modulating valves, the output level of the first and second gas burners so that the first gas burner has a lower output level than the second gas burner, when maintaining a predetermined temperature in the oven compartment, thereby relocating a hot spot in the oven compartment and disrupting airflow in the oven compartment.

In some embodiments, the cooking appliance additionally includes a third gas burner positioned to supply heat to the oven compartment and a third electromechanical modulating valve that couples the third gas burner to a gas supply. In some such embodiments, the controller is further configured to vary, by the electromechanical modulating valves, the respective output levels of the first, second, and third gas burners when maintaining a predetermined temperature in the oven compartment.

In some embodiments, each of the first and second electromechanical modulating valves is a stepper motor-controlled plug valve. In other embodiments, each of the first and second electromechanical modulating valves is a voice coil solenoid valve.

In yet another aspect, a cooking appliance includes: an oven compartment; first and second gas burners positioned to supply heat to the oven compartment; where the first and second gas burners respectively include first and second electromechanical modulating valves that respectively couple the first and second gas burners to a gas supply; and a controller configured to control the first and second gas burners to heat the oven compartment, where the controller is further configured to, when maintaining a predetermined temperature in the oven compartment, control the electromechanical modulating valves of the first and second gas burners to vary respective output levels of the first and second gas burners while maintaining a substantially constant combined output level for the first and second gas burners; and where the controller is further configured to modify a frequency of the varying of the respective output levels of the first and second gas burners, thereby resulting in a disruption of an airflow pattern in the oven compartment.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

FIG. 3A is a front view of the cooking appliance; FIG. 3B is a side view of the appliance.

FIG. 6A illustrates a first exemplary airflow pattern; FIG. 6B illustrates a second exemplary airflow pattern.

DETAILED DESCRIPTION

Figure 1:
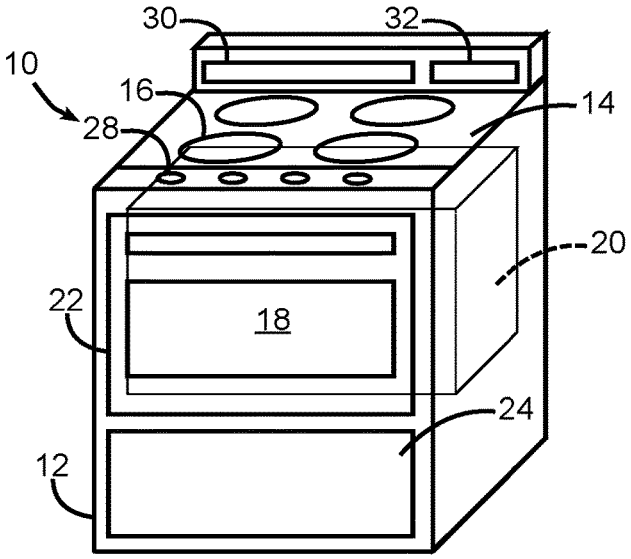
FIG. 1 is a perspective view of a cooking appliance consistent with some embodiments of the invention.

Turning now to the drawings, wherein like numbers denote like parts throughout the several views, FIG. 1 illustrates an example appliance, for example in this instance a cooking appliance 10, in which the various technologies and techniques described herein may be implemented. Cooking appliance 10 is a residential-type range, and as such includes a housing 12, a stovetop or cooktop 14 including a plurality of gas burners 16, and an oven 18 defining an oven or cooking cavity or compartment 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more gas heating elements.

Cooking appliance 10 may also include various user interface devices, including, for example, control knobs 28 for controlling the gas burners 16, a control panel 30 for controlling oven 18 and/or burners 16, and a display 32 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a wall mount or freestanding oven. In general, a cooking appliance consistent with the invention may be considered to include any residential-type appliance including a housing and one or more cooking elements disposed therein and configured to generate energy for cooking food within one or more oven cavities or compartments.

Figure 2:
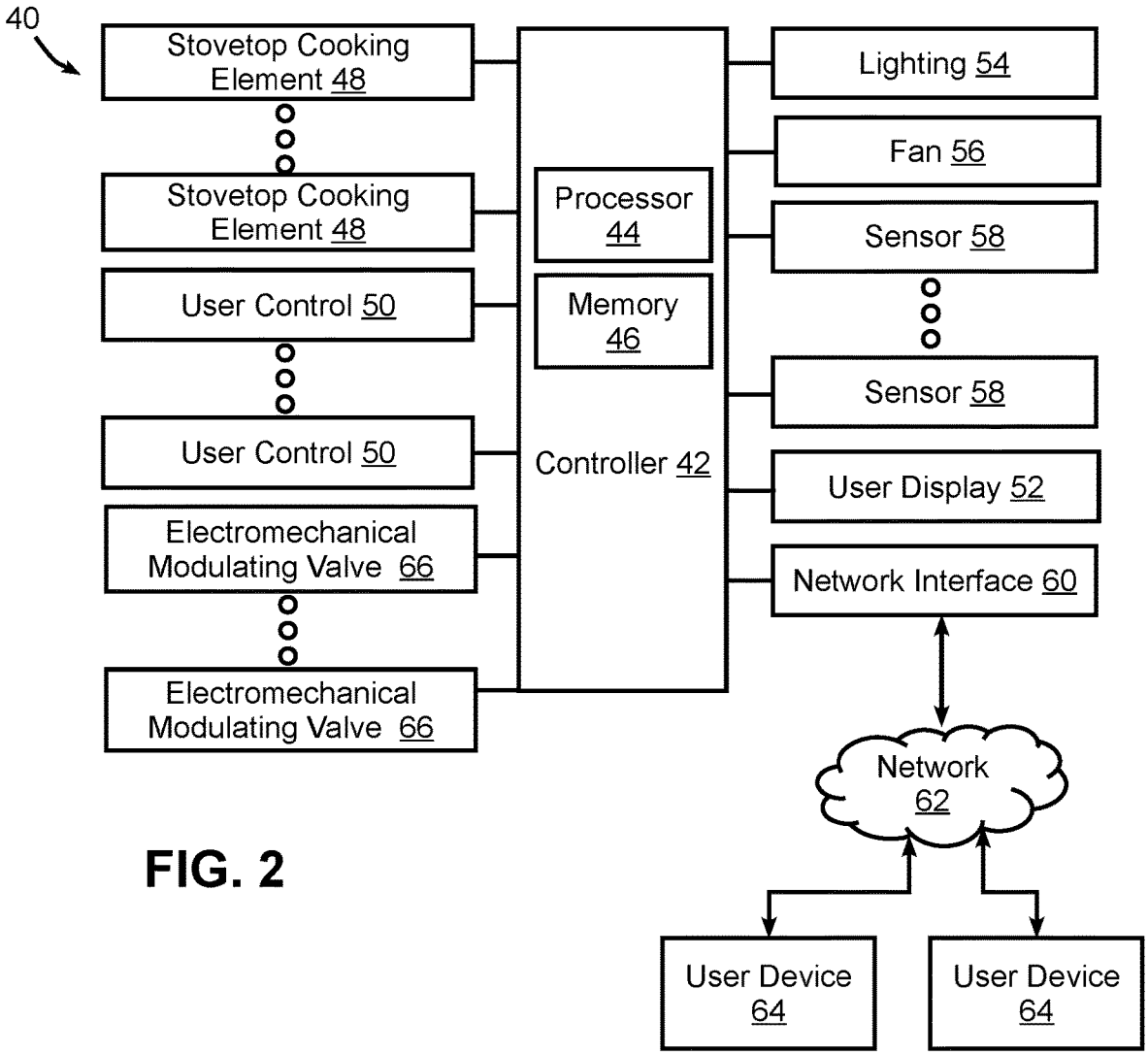
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including elements of both the cooktop and oven. For example, the controller 42 may be interfaced with the various stovetop cooking elements 48 used for cooking food. The controller may also be interfaced with one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others. Finally, controller 42 may also be interfaced with one or more electromechanical modulating valves 66, which may be couple the gas burners of the oven to a gas supply.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, and/or odor sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity or compartment.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Modulating Gas Burner Control in an Oven

As discussed previously, a gas burner of an oven may need enough power to reach high temperatures, for example to be able to run self-clean cycle (e.g. approximately 800 degrees Fahrenheit). Further, a high power burner may also be desirable for quick preheating times; however, there is also a need to reduce the power to maintain a set temperature when cooking. As such, these power needs may result in large swings in the temperature when attempting to maintain a set temperature (e.g. 350 degrees Fahrenheit). A need continues for a manner of regulating oven temperature in a gas cooking appliance over a wide range of temperatures.

Accordingly, a gas cooking appliance is described herein including an oven compartment and first and second gas burners positioned to supply heat to the oven compartment. The first and second gas burners each include an electromechanical modulating valve that couples the gas burner to a gas supply. A controller allows for control of the burners while maintaining a predetermined temperature in the oven compartment through control of the electromechanical modulating valves to vary output levels of the first and second gas burners while also maintaining a substantially constant combined output level for the first and second gas burners.

Figure 3A:
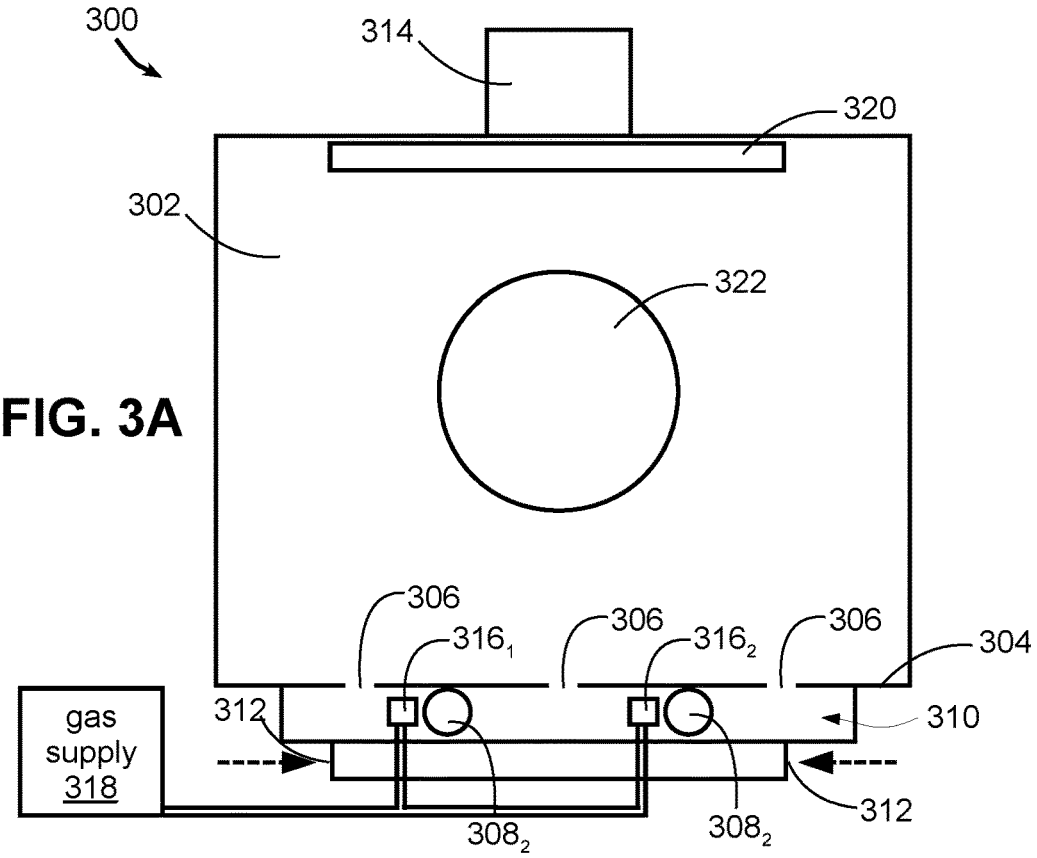
FIGS. 3A-B are views of a cooking appliance consistent with some embodiments described herein.
Figure 3B:
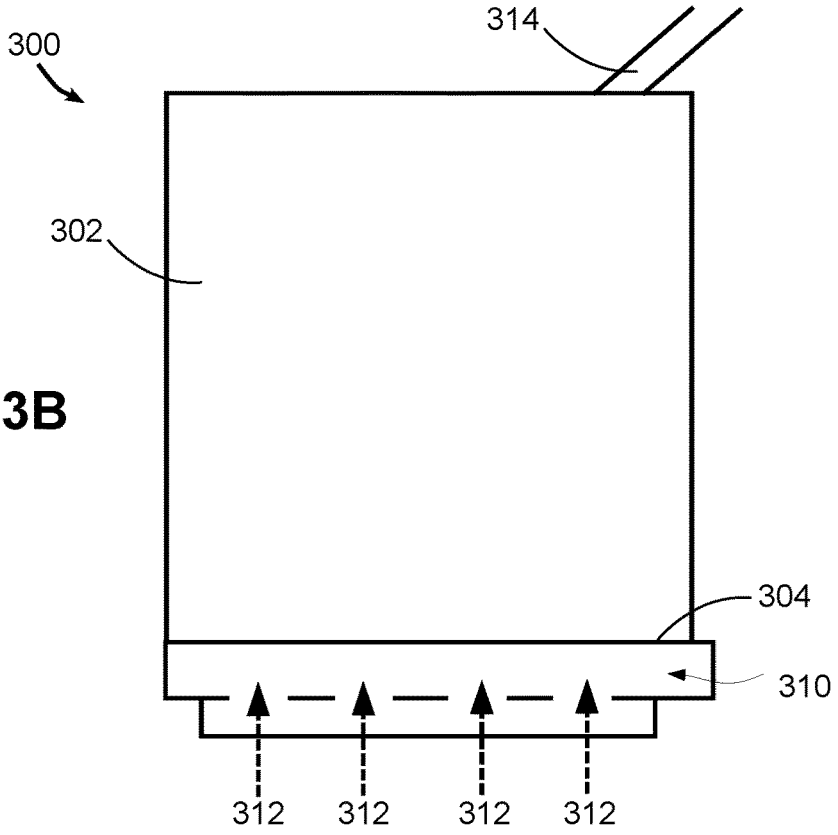

In some variations, a controller may be able to vary the output of the first and second gas burners, via the electromechanical modulating valves, between each burner's minimum output level and each burner's maximum output level. In such instances, the minimum output level may be a non-zero output level at which a flame may be maintained by the gas burner. This allows for more precise control of the temperature within the cavity. In another variation, the frequency with which the gas burners are varied or cycled between different outputs may be modified by the controller, which may result in a disruption in the airflow pattern in the oven compartment. Turning now to FIGS. 3A-B, which illustrate a gas cooking appliance 300 consistent with some embodiments described herein. FIG. 3A is a front view of the cooking appliance 300, while FIG. 3B is a side view of the gas cooking appliance 300. The gas cooking appliance 300 may include an oven compartment or cavity 302, into which food items may be placed to be heated or cooked. The cavity 302 may include a bottom 304 with one or more openings 3061-*n*. There are three openings illustrated in FIG. 3A, but this is not to be understood as limiting; in some embodiments there may only be one or two openings, while in other embodiments, here may be four or more openings. These openings 306, may allow hot air to pass into and heat the cavity 302. While these openings may typically be slender and run from the front of the cavity 302 to the rear, the size and shape of the opening is not limited. The gas cooking appliance 300 may also include one or more broiler burners 320 at the top of the oven cavity 302.

The burner box 310, which may be disposed below the cavity 302, may also include one or more air inlets 312 for ambient air to enter the cooking appliance 300. These inlets 312 may be any shape and size known to those of skill in the art. The entry of this ambient air is illustrated in FIG. 3A-B by the broken arrows. This ambient air may then be heated and flow through the cavity 302, as will be discussed in detail with respect to FIGS. 6A-B, before exiting through an oven vent 314.

The gas burners $308_1$, $308_2$ may be any type of gas burner known in the art. Although, there are two gas burners $308_1$, $308_2$ illustrated in FIG. 3A, however this is also not intended to be limiting; in some instances, there may be three or more gas burners (see, for example, FIG. 7). Each of the one or more gas burners $308_{1-n}$ may additionally include a electromechanical modulating valve $316_{1-n}$ that respectively couples each of the gas burners 308 to a gas supply 318. In some instances, the electromechanical modulating valves $316_{1-n}$ may be directly coupled to the gas supply, while in other instances the electromechanical modulating valves $316_{1-n}$ may be indirectly coupled to the gas supply. These electromechanical modulating valve $316_{1-n}$ may be used to facilitate control of the flow of gas to the gas burner(s) $308_{1-n}$. For example, the electromechanical modulating valves $316_{1-n}$ may facilitate an adjustment of an output level for the gas burners $308_{1-n}$. In some instances, the electromechanical modulating valve may be a stepper motor-controlled plug valve; while in other instances, the electromechanical modulating valve may be a voice coil solenoid valve, or any other suitable variable valve design. Once the oven is preheated and the cooking appliance is maintaining the predetermined temperature setpoint ($T_{set}$) in the oven compartment, a controller (such as controller 42 described with reference to FIG. 2) may control the electromechanical modulating valves $316_{1-n}$ of the gas burner(s) $308_{1-n}$ in order to vary the output levels. In some instances, it may be desirable for the electromechanical modulating valves $316_{1-n}$ to vary the output gas burner(s) $308_{1-n}$ while simultaneously maintaining a substantially constant output level across all of the gas burners $308_{1-n}$. In some instances, the output levels of the gas burners $308_{1-n}$ may vary between a minimum output level and a maximum output level. In such instances, the minimum output level may be a non-zero output level at which a flame of the gas burner may be maintained. In some instances, the gas burners $308_{1-n}$ may be the same size and have the same output ranges; while in other instances, the gas burners $308_{1-n}$ may differ in size and/or output ranges. Where the gas burners $308_{1-n}$ are different sizes and/or have different output ranges, the gas burners $308_{1-n}$ may, in some instances, have overlapping output ranges. For example, this overlap in ranges may occur where the minimum output of a larger burner $308_1$ is less than the maximum of a smaller burner $308_2$.

This variation of the output for the gas burners $308_{1-n}$ may generate disruptions in the airflow pattern in the oven cavity 302. In contrast, some cooking appliances may contain only a single burner that is either on or off. This on/off cycling may result in a sawtooth time-temperature curve. Such on-off cycling may also result in an airflow pattern where hotspots and cool-spots exist within the cavity 302. Use of electromechanical modulating valves $316_{1-n}$ to vary the output of the gas burner(s) $308_{1-n}$ disrupts this airflow pattern.

Figure 4:
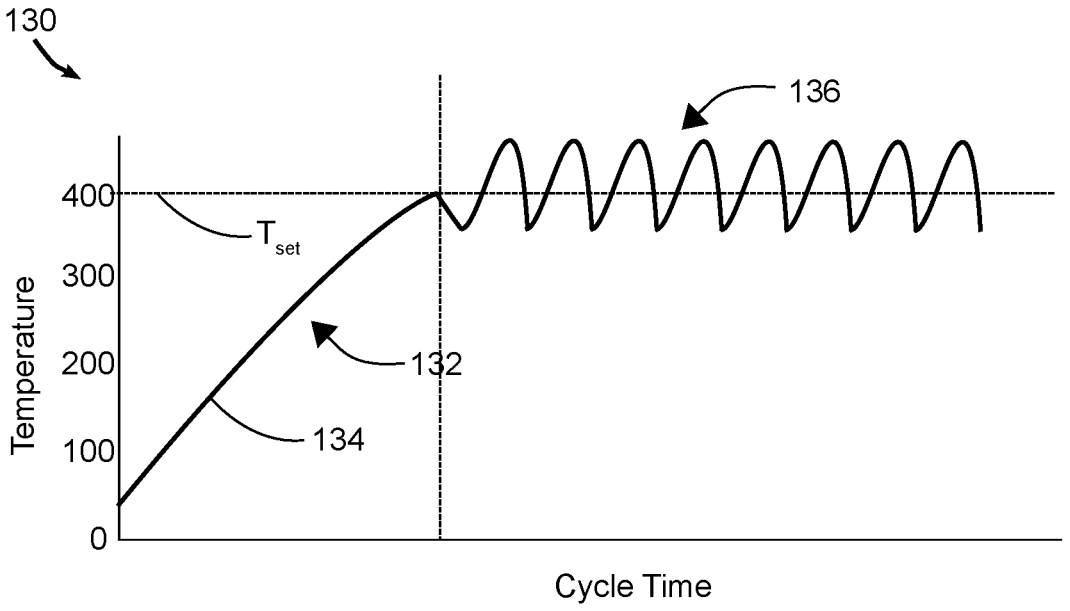
FIG. 4 is a graph of an example time-temperature curve of an exemplary cooking appliance.

FIG. 4, as an example, illustrates a graph 130 of a time-temperature curve 132 for an oven of a cooking appliance that employs an unmodulated gas burner that operates in either a fully on or fully off state. The initial portion 134 of the curve may be indicative of a preheat time. Based on, for example, a user input, the controller 42 may initiate heating to a temperature setpoint ($T_{set}$), which is illustrated in FIG. 4 by a broken line. The controller 42 may activate the gas burner to its on state to achieve this desired temperature. The air temperature within the oven compartment or cavity may then be monitored, for example using one or more temperature sensors 58 disposed within the oven cavity, until the selected temperature setpoint ($T_{set}$) is reached, after which the gas burner may be turned off. Sometime thereafter, the temperature will drop below the temperature setpoint ($T_{set}$), at which point the gas burner may be turned back on, and cause the temperature to rise, and in many cases overshoot the temperature setpoint ($T_{set}$). This may result in a "sawtooth" pattern 136 of the temperature within the oven cavity, as illustrated in FIG. 4. This pattern often results in relatively wide temperature swings, while attempting "average" a temperature near that of the temperature setpoint ($T_{set}$).

Figure 5:
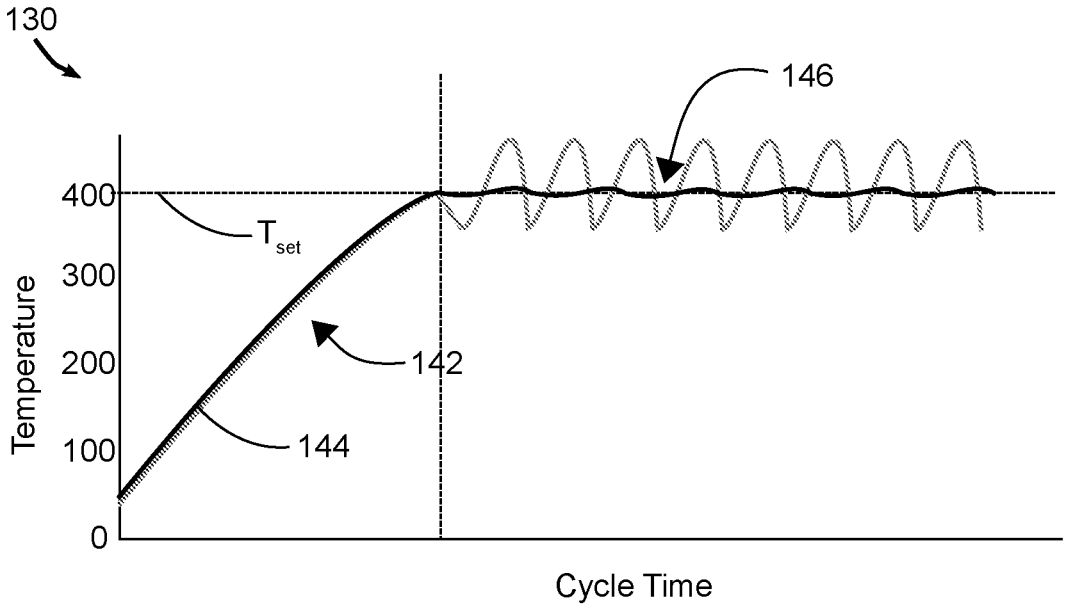
FIG. 5 is a graph of an example time-temperature curve of another exemplary cooking appliance.

FIG. 5 illustrates the time-temperature curve 132 of FIG. 4 in gray as well as a second time-temperature curve 142 that may be generated in a manner consistent with some embodiments described herein. As described with reference to FIG. 4, the initial portion 144 of the curve may be indicative of a preheat time that is based on, for example, a user input. The controller 42 may initiate heating to a temperature setpoint ($T_{set}$), which, as in FIG. 4, is illustrated by a broken line. Once the one or more gas burners are ignited, the air temperature within the oven cavity or compartment is monitored, for example using one or more temperature sensors 58 disposed within the oven cavity, until selected temperature setpoint ($T_{set}$) is reached. Once the temperature setpoint ($T_{set}$) is reached one or more electromechanical modulating valves described in detail herein may vary an output level, for example via controller 42, of the gas burner(s) to maintain a smoother temperature fluctuation pattern 146 after reaching the temperature setpoint ($T_{set}$) of the time-temperature curve 142. As is visible in FIG. 5, the temperature does not fluctuate as widely as the sawtooth pattern 136 of FIG. 4.

Figure 6A:
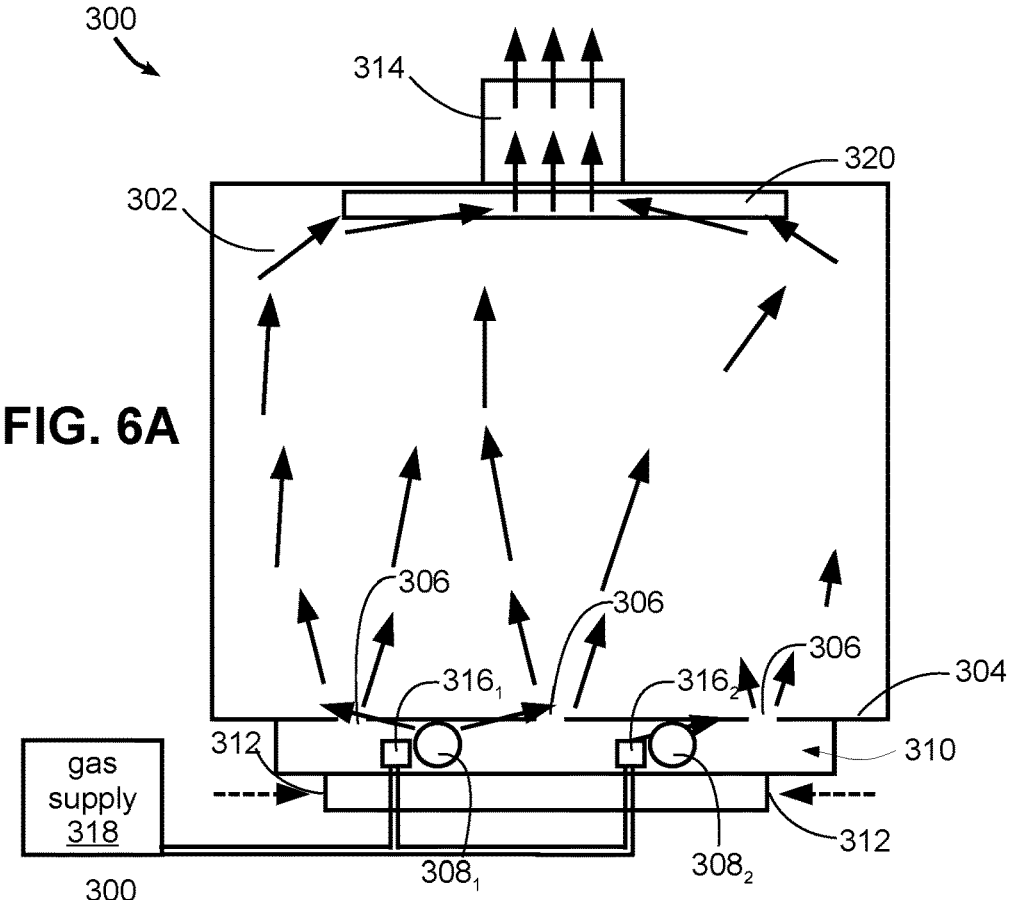
FIG. 6A-B are exemplary airflow patterns of a cooking appliance consistent with some embodiments described herein.
Figure 6B:
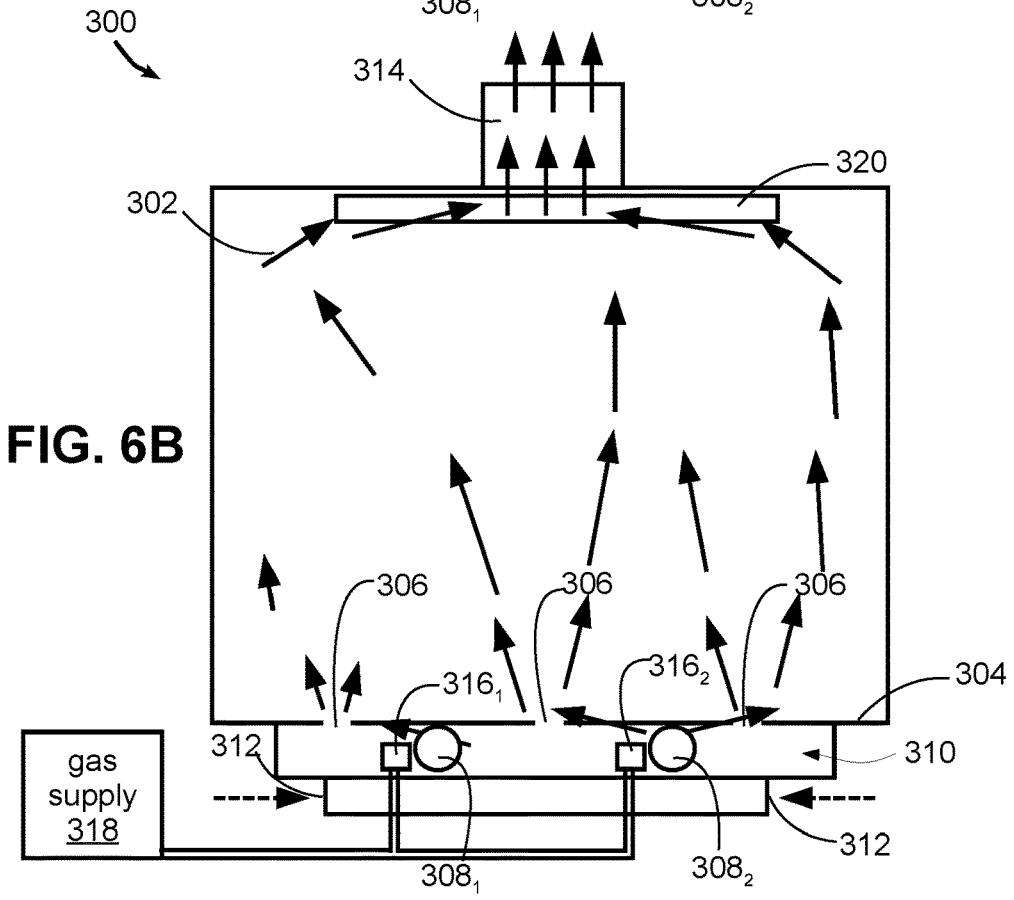

Turning now to FIGS. 6A-B, these figures illustrate an exemplary airflow through the cooking appliance 300. The broken arrows indicate the entry of ambient air into the cooking appliance 300, this air may then be heated and flow through the cavity 302. This heated air, as illustrated with solid arrows, flows through the cavity 302 before exiting through an oven vent 314. In FIG. 6A, the output of a first gas burner $308_1$ is greater than that of a second gas burner $308_2$; in FIG. 6B, the output of a first gas burner $308_1$ is less than that of a second gas burner $308_2$. The electromechanical modulating valves $316_{1-n}$ of the gas burner(s) $308_{1-n}$ allow for regulation and modification of these outputs. A total output, or the output of all the gas burners $308_{1-n}$ combined, may substantially remain constant regardless of the individual output of each individual gas burners $308_{1-n}$, as illustrated in FIGS. 6A-B. In some instances, the controller may cyclically vary the output of the gas burners $308_{1-n}$ using the electromechanical modulating valves $316_{1-n}$. As an example, the controller may cycle between the output illustrated in FIG. 6A and the output illustrated in FIG. 6B. This may, in some instances, relocate hot spots within the oven cavity 302 and disrupt airflow in the oven cavity 302. Disrupting the airflow pattern may generally create variation in the temperature distribution within the cavity 302 to promote more even cooking.

In some instances, the controller may modify the frequency with which the output of the gas burners $308_{1-n}$ are varied using the electromechanical modulating valves $316_{1-n}$. For example, in some instances, it may be desirable to rapidly vary the outputs between the first and the second gas burners $308_1$, $308_2$, while maintaining a substantially constant total output. In other instances, it may be desirable to establish a pattern for varying the outputs between the first and the second gas burners $308_1$, $308_2$, while maintaining a substantially constant total output. For example, the outputs may be cycled between the gas burners $308_1$, $308_2$ after a pre-determined period of time. In other instances, it may be desirable to vary the outputs between the first and the second gas burners $308_1$, $308_2$, while maintaining a substantially constant total output, in an irregular or random manner. For example, the outputs may be randomly cycled as generated by the controller.

In some instances, a convection fan 322 may also be used to further circulate air within the oven cavity 302. In some instances, such a convection fan 322 may be controlled by a controller (i.e. controller 42 of FIG. 2). In such instances, the controller may trigger the running of the convection fan 322 according to a schedule, based on a sensed temperature in the oven cavity 302, based on some predefined relationship between the gas burners $308_1$, $308_2$, and/or any other preprogrammed triggering event.

Figure 7:
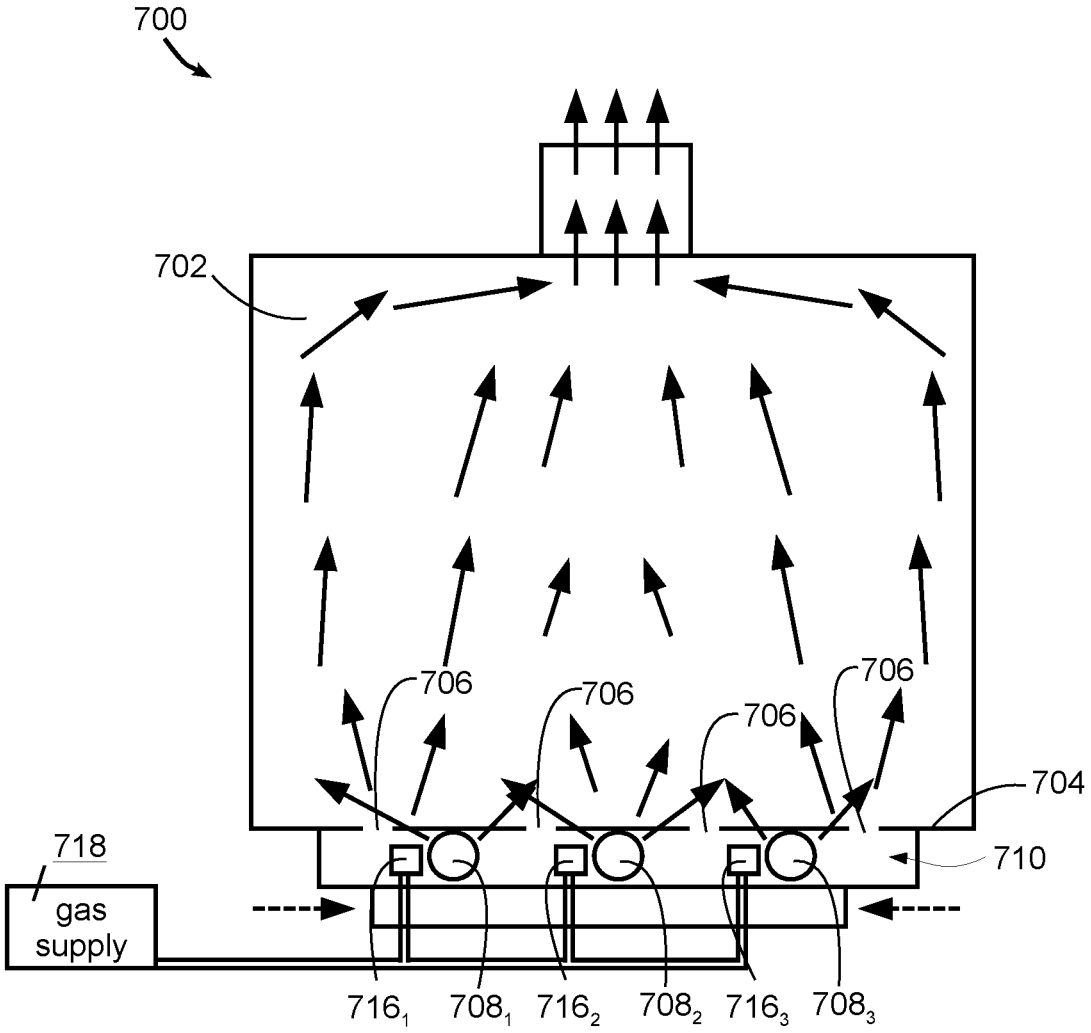
FIG. 7 is another exemplary airflow pattern of a cooking appliance consistent with some embodiments described herein.

Although the gas cooking appliance 300 of FIGS. 6A-B is illustrated as including a first and second gas burner $308_1$, $308_2$, this is not to be understood to be limiting. In some instances, such as illustrated in FIG. 7, the cooking appliance 700 may include three or more gas burners $708_1$, $708_2$, $708_3$. The cooking appliance 700 of FIG. 7, similar to other embodiments described herein, includes an oven compartment or cavity 702, into which food items may be placed to be heated or cooked. The cavity 702 may further include a bottom 704 with one or more openings 7061-*n* that may allow hot air into the cavity 702 from a burner box 710. This hot air may, for example, be heated by the three gas burners $708_1$, $708_2$, $708_3$ disposed in a burner box 710 below the cavity 702.

As described previously, each of the gas burners $708_1$, $708_2$, $708_3$ may additionally include an electromechanical modulating valve $716_{1\text{-}n}$ that respectively couples each of the gas burners $708_1$, $708_2$, $708_3$ to a gas supply 718. As described with reference to FIGS. 6A-B, these electromechanical modulating valves $716_{1\text{-}n}$ may be used to facilitate control of the flow of gas to the gas burner(s) $708_{1\text{-}n}$. For example, the electromechanical modulating valves $716_{1\text{-}n}$ may facilitate an adjustment of an output level for the gas burners $708_{1\text{-}n}$, while the total output (of all gas burners $708_1$, $708_2$, $708_3$) remains substantially constant. In some instances, the electromechanical modulating valves $716_{1\text{-}n}$ may allow the output of the gas burners $708_1$, $708_2$, $708_3$ to range from a minimum output to a maximum output and anywhere between. In some instances, the controller (such as controller 42 described with reference to FIG. 2) may cyclically vary the output of the gas burners $708_1$, $708_2$, $708_3$ using the electromechanical modulating valves $716_{1\text{-}n}$. As an example, the second gas burner gas burner $708_2$ of FIG. 7 has a lower output compared to the first and third gas burners $708_1$, $708_3$, the controller may cycle that lower output between each of the three gas burners $708_1$, $708_2$, $708_3$ so that at different points in time each of the three gas burners $708_1$, $708_2$, $708_3$ will have the lower output. This may, in some instances, relocate hot spots within the oven cavity 702 and disrupt airflow in the oven cavity 702. Disrupting the airflow pattern may generally create variation in the temperature distribution within the cavity 702 to promote more even cooking.

It will be appreciated that various modifications may be made to the embodiments discussed herein, and that a number of the concepts disclosed herein may be used in combination with one another or may be used separately.

The invention claimed is:

1. A cooking appliance comprising:

an oven compartment;

first and second gas burners positioned to supply heat to the oven compartment;

wherein the first and second gas burners respectively include first and second electromechanical modulating valves that respectively couple the first and second gas burners to a gas supply; and a controller configured to control the first and second gas burners to heat the oven compartment, wherein the controller is further configured to, when maintaining a predetermined temperature in the oven compartment, control the electromechanical modulating valves of the first and second gas burners to individually vary respective output levels of the first and second gas burners while maintaining a substantially constant combined output level for the first and second gas burners.

2. The cooking appliance of claim 1, wherein the controller is further configured to vary respective output levels of the first and second gas burners between a minimum output level and a maximum output level, when maintaining the predetermined temperature in the oven compartment.

3. The cooking appliance of claim 2, wherein the controller is further configured to modify a frequency of the varying of the respective output levels of the first and second gas burners when maintaining the predetermined temperature in the oven compartment.

4. The cooking appliance of claim 1, wherein the first gas burner has a higher output level than the second gas burner; and wherein the controller is further configured to vary, by the electromechanical modulating valves, the output level of the first and second gas burners so that the first gas burner has a lower output level than the second gas burner, when maintaining a predetermined temperature in the oven compartment, thereby relocating a hot spot in the oven compartment and disrupting airflow in the oven compartment.

5. The cooking appliance of claim 1, wherein the controller is further configured to vary, by the electromechanical modulating valves, the respective output levels of the first and second gas burners in an irregular manner, when maintaining a predetermined temperature in the oven compartment, thereby resulting in a disruption of an airflow pattern in the oven compartment.

6. The cooking appliance of claim 1, wherein the controller is further configured to vary the respective output levels of the first and second gas burners in a regular pattern, when maintaining a predetermined temperature in the oven compartment, thereby resulting in a disruption of an airflow pattern in the oven compartment.

7. The cooking appliance of claim 1, wherein the controller is further configured to modify a frequency of the varying of the respective output levels of the first and second gas burners when maintaining a predetermined temperature in the oven compartment.

8. The cooking appliance of claim 1 further comprising a third gas burner positioned to supply heat to the oven compartment and a third electromechanical modulating valve that couples the third gas burner to a gas supply.

9. The cooking appliance of claim 8, wherein the controller is further configured to vary, by the electromechanical modulating valves, the respective output levels of the first, second, and third gas burners when maintaining a predetermined temperature in the oven compartment.

10. The cooking appliance of claim 1, wherein each of the first and second electromechanical modulating valves is a stepper motor-controlled plug valve.

11. The cooking appliance of claim 1, wherein each of the first and second electromechanical modulating valves is a voice coil solenoid valve.

12. The cooking appliance of claim 1, wherein the first gas burner is larger than the second gas burner, and wherein the first gas burner has an output range that overlaps with an output range of the second gas burner.

13. A cooking appliance comprising:

an oven compartment;

first and second gas burners positioned to supply heat to the oven compartment;

wherein the first and second gas burners respectively include first and second electromechanical modulating valves that respectively couple the first and second gas burners to a gas supply, and wherein each of the first and second electromechanical modulating valves is a stepper motor-controlled plug valve; and a controller configured to control the first and second gas burners to heat the oven compartment, wherein the controller is further configured to, when maintaining a predetermined temperature in the oven compartment, control the electromechanical modulating valves of the first and second gas burners to vary respective output levels of the first and second gas burners between a minimum output level and a maximum output level.

14. The cooking appliance of claim 13, wherein the controller is further configured to maintain a substantially constant combined output level for the first and second gas burners when maintaining a predetermined temperature in the oven compartment.

15. The cooking appliance of claim 13, wherein the controller is further configured to modify a frequency of the varying of the respective output levels of the first and second gas burners when maintaining a predetermined temperature in the oven compartment.

16. The cooking appliance of claim 13, wherein the first gas burner has a higher output level than the second gas burner; and wherein the controller is further configured to vary, by the electromechanical modulating valves, the output level of the first and second gas burners so that the first gas burner has a lower output level than the second gas burner, when maintaining a predetermined temperature in the oven compartment, thereby relocating a hot spot in the oven compartment and disrupting airflow in the oven compartment.

17. The cooking appliance of claim 13 further comprising a third gas burner positioned to supply heat to the oven compartment and a third electromechanical modulating valve that couples the third gas burner to a gas supply.

18. The cooking appliance of claim 17, wherein the controller is further configured to vary, by the electromechanical modulating valves, the respective output levels of the first, second, and third gas burners when maintaining a predetermined temperature in the oven compartment.

19. The cooking appliance of claim 17, wherein the third electromechanical modulating valve is a voice coil solenoid valve.

20. A cooking appliance comprising:

an oven compartment;

first and second gas burners positioned to supply heat to the oven compartment;

wherein the first and second gas burners respectively include first and second electromechanical modulating valves that respectively couple the first and second gas burners to a gas supply; and a controller configured to control the first and second gas burners to heat the oven compartment, wherein the controller is further configured to, when maintaining a predetermined temperature in the oven compartment, control the electromechanical modulating valves of the first and second gas burners to vary respective output levels of the first and second gas burners while maintaining a substantially constant combined output level for the first and second gas burners;

wherein the controller is further configured to modify a frequency of the varying of the respective output levels of the first and second gas burners, thereby resulting in a disruption of an airflow pattern in the oven compartment.

* * * * *